US009532598B2

(12) United States Patent
Liu

(10) Patent No.: US 9,532,598 B2
(45) Date of Patent: Jan. 3, 2017

(54) ELECTRONIC CIGARETTE ATOMIZER

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 890 days.

(21) Appl. No.: 13/901,317

(22) Filed: May 23, 2013

(65) Prior Publication Data

US 2014/0311504 A1 Oct. 23, 2014

Related U.S. Application Data

(63) Continuation of application No. PCT/CN2013/074371, filed on Apr. 18, 2013.

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2013/0180533 A1* 7/2013 Kim ..... A24F 47/008 131/273
2014/0014124 A1* 1/2014 Glasberg ..... A24F 47/008 131/328

FOREIGN PATENT DOCUMENTS

CN 1284493 C 11/2006
CN 201830900 U 5/2011
CN 202774133 U 3/2013
WO 2012142293 A2 10/2012

OTHER PUBLICATIONS

International Search Report mailed Jan. 23, 2014 in International Application No. PCT/CN2013/074371 filed Apr. 18, 2013.

* cited by examiner

*Primary Examiner* — Michael J Felton
(74) *Attorney, Agent, or Firm* — Tim Tingkang Xia, Esq.; Locke Lord LLP

(57) ABSTRACT

The present invention refers to an electronic cigarette atomizer, which comprises a heating wire component and a breather pipe, the heating wire component further comprises a heating body, one end of the breather pipe defines at least one U-shaped opening(s), the heating body is embedded in the U-shaped opening(s). In assembly of an electronic cigarette atomizer in the present invention, the heating wire component and the electrode part are formed integrally, the assembly of the electronic cigarette atomizer can be accomplished via the operation of aligning the U-shaped opening with the heating wire component and inserting the U-shaped opening into the heating wire component, there is no need to perform actions of insertion of the lead pins. The electronic cigarette atomizer is simple in assembly, the electronic cigarette atomizer avoids inaccurate alignments formed between the heating wire component and the electrode and improves the production efficiency.

6 Claims, 5 Drawing Sheets

ELECTRONIC CIGARETTE ATOMIZER

CROSS-REFERENCE TO RELATED APPLICATIONS

This application is a continuation of International Patent Application No. PCT/CN2013/074371, with an international filing date of Apr. 18, 2013, designating the United States. The contents of these specifications are incorporated herein by reference.

FIELD OF THE INVENTION

The present invention relates to the technical field of electronic cigarette, and more particularly, to a kind of electronic cigarette atomizer.

BACKGROUND OF THE INVENTION

Electronic cigarette is a kind of electronic products, which is configured for heating tobacco juice by a heating wire and making the tobacco juice be atomized. Nowadays, electronic cigarette are provided to smokers as substitutes of real cigarettes. In use of an electronic cigarette, the tobacco juice is transformed into aerial fog after being heated, and the aerial fog flows through a breather pipe and arrives at the exterior of the electronic cigarette via an opening of a suction nozzle cover. The core components of the electronic cigarette are the heating wire and the breather pipe. As shown in FIG. 1, in the prior art, an electronic cigarette atomizer comprises a hollow outer sleeve 180, a male screw bushing 110 engaging with one end of the outer sleeve 180, a dead ring 130 and a top electrode 120 inserted into the dead ring 130 and engaging with the male screw bushing 110. In assembly, a heating wire component 140 is inserted into a hollow breather pipe 150 firstly and is mounted inside the outer sleeve 180 subsequently. Two lead pins of the heating wire component 140 are in contact with the male screw bushing 110 and the top electrode 120 respectively. When the breather pipe 150 is assembled, a cavity is formed between the breather pipe 150 and the outer sleeve 180, and oil-absorbing cotton 160 is received in the cavity. Finally, a suction nozzle cover 170 is attached to an opening of the other end of the outer sleeve 180.

The breather pipe 150 defines at least one through-hole(s) passing through a pipe body thereof in a center portion of the pipe body. In assembly, one lead pin of the heating wire component 140 is configured to pass through the through-hole(s), which provides guidance for the main body of the heating wire component 140 to pass through the through-hole(s). However, the assembly method is seriously inconvenient. Furthermore, the lead pins of the heating wire component 140 are very long and may be bent during assembly, and it is difficult to accurately align and assemble the two lead pins of the heating component, which causes low production efficiency.

SUMMARY OF THE INVENTION

The objective of the present invention is to provide a type of electronic cigarette atomizer which aims at the drawback of low production efficiency of an electronic cigarette atomizer in the prior art and overcome the aforementioned drawback.

The technical solution of the present invention is implemented through a type of electronic cigarette atomizer, the electronic cigarette atomizer comprises a heating wire component 240 and a breather pipe 250, the heating wire component 240 includes a heating body 243, one end of the breather pipe 250 defines at least one U-shaped opening(s) therein, and the heating body 243 of the heating wire component 240 is embedded in the U-shaped opening(s).

In an electronic cigarette atomizer of the present invention, the electronic cigarette atomizer further comprises a male screw bushing 210 and a top electrode 220 inserted into a dead ring 230, the dead ring 230 is in tight contact with an inner wall of the male screw bushing 210, the top electrode 220 is electrically isolated from the male screw bushing 210, the heating body 243 is entwined by a heating wire, two ends of the heating wire extend to be connect to a first lead pin 241 and a second lead pin 242 respectively, the first lead pin 241 inserts between the dead ring 230 and the top electrode 220, and the second lead pin 242 inserts between the dead ring 230 and the male screw bushing 210.

In an electronic cigarette atomizer of the present invention, the heating body 243 passes a central axis of the top electrode 220 and is perpendicular to the central axis of the top electrode 220.

In an electronic cigarette atomizer of the present invention, the dead ring 230 is made of rubber or silica gel.

In an electronic cigarette atomizer of the present invention, an outer diameter of the dead ring 230 is longer than an inner diameter of the male screw bushing 210, and an inner diameter of the dead ring 230 is shorter than an outer diameter of the top electrode 220.

In an electronic cigarette atomizer of the present invention, the electronic cigarette atomizer further comprises an outer sleeve 280, the male screw bushing 210 is in a threaded connection with one end of the outer sleeve 280, and a suction nozzle cover 270 inserts into the other end of the outer sleeve 280; the suction nozzle cover 270 defines through-hole(s) therein, and the through-hole(s) communicate(s) with the breather pipe 250.

In an electronic cigarette atomizer of the present invention, a reception space is formed between the outer sleeve 280 and the breather pipe 250, and the reception space receives oil-absorbing cotton 260 therein.

In an electronic cigarette atomizer of the present invention, the first lead pin 241 and the second lead pin 242 include bent parts.

In an electronic cigarette atomizer of the present invention, the heating wire component 240, the first lead pin 241 and the second lead pin 242 are formed integrally.

When implementing the electronic cigarette atomizer of the present invention, the following advantageous effects can be achieved: the heating wire component and the electrode part are formed integrally, and the assembly of the electronic cigarette atomizer can be accomplished via only the operation of aligning the U-shaped opening(s) with the heating wire component and inserting the U-shaped opening (s) into the heating wire component, and it is unnecessary to perform actions of insertion of the lead pins. An electronic cigarette atomizer in the present invention is simple in assembly, inaccurate alignments formed between the heating wire component and the electrode is avoided, and the production efficiency is improved.

BRIEF DESCRIPTION OF THE DRAWINGS

The invention and technical solution will be illustrated with reference to accompanying drawings in the following. In the figures.

DETAILED DESCRIPTION OF THE PREFERRED EMBODIMENT

Specific implementations of the present invention is explained in detail in accordance with accompanying drawings so that the technical feature, objective and effect of the present invention can be understood more clearly.

Figure 1:
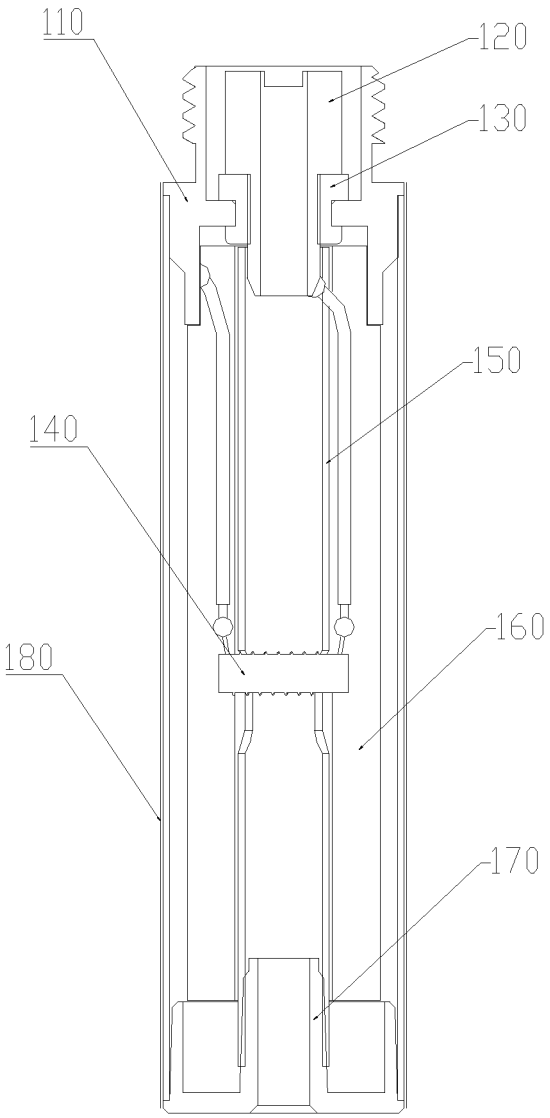
FIG. 1 is a structurally schematic view of an electronic cigarette atomizer in the prior art.
Figure 2:
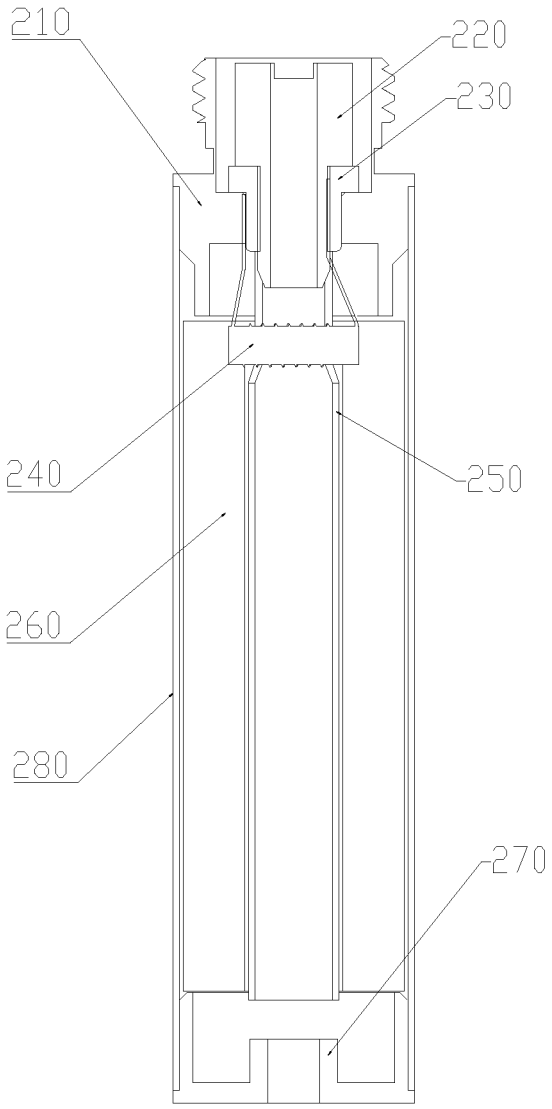
FIG. 2 is a structurally schematic view of an electronic cigarette atomizer in the present invention.

In order to solve the drawback of low production efficiency caused by the difficulty in assembly of the existing electronic cigarette atomizer shown in FIG. 1, an electronic cigarette atomizer shown in FIG. 2 is provided in the present invention. The electronic cigarette atomizer of the present invention comprises a male screw bushing 210 and a top electrode 220, and the male screw bushing 210 and a battery rod component of an electronic cigarette are assembled together via a threaded connection. When the male screw bushing 210 is connected to the battery rod component, the male screw bushing 210 and the top electrode 220 are connected to a positive electrode and a negative electrode of the battery respectively. To prevent short circuit incidents, the top electrode 220 is insert into a dead ring 230 firstly, and the dead ring 230 engages with the interior of the male screw bushing 210 subsequently, thereby making the male screw bushing 210 and the top electrode 220 be electrically isolated from each other.

The electronic cigarette atomizer further comprises a heating wire component 240. One lead pin of the heating wire component 240 inserts into a gap formed between the top electrode 220 and the dead ring 230, the other lead pin of the heating wire component 240 inserts into a gap formed between the male screw bushing 210 and the dead ring 230, so that the two lead pins are electrically connected to the male screw bushing 210 and the top electrode 220 respectively. When electric current passes the heating wire component 240, it is transformed into heat. A main heating body of the heating wire component 240 is positioned adjacent to the top electrode 220, the lead pin of the heating wire component 240 is very short, so that the whole heating wire component 240, the male screw bushing 210, the top electrode 220 and the dead ring 230 cooperatively form an electrode part.

The electronic cigarette atomizer further comprises a breather pipe 250, which is hollow and cylinder-shaped. One end of the breather pipe 250 defines at least one U-shaped opening(s) therein. For example, in the embodiment of the present invention, two U-shaped openings of the same size are defined in two opposite positions of one end of the breather pipe 250 respectively, and the two U-shaped openings is aligned with and inserted into the heating wire component 240, such that the heating body of the heating wire component 240 is positioned inside the hollow interior of the breather pipe 250. Besides, because the main heating body of the heating wire component 240 matches with the structure of the U-shaped opening(s), a structure of the electronic cigarette atomizer becomes more compact, and the heating body is prevented from being dropped from the U-shaped opening(s) of the breather pipe 250.

An outer sleeve 280 is mounted on an outer surface of the electronic cigarette atomizer, and the outer sleeve 280 is hollow and cylinder-shaped. The male screw bushing 210 screws into an opening of one end of the outer sleeve 280, and a reception space is formed between the outer sleeve 280 and the breather pipe 250. A piece of oil-absorbing cotton 260 is received inside the reception space. Liquid tobacco juice is stored in the oil-absorbing cotton 260. A suction nozzle cover 270 is attached to the other end of the outer sleeve 280, a center of the suction nozzle cover 270 defines through-hole(s) therein, and the through-hole(s) communicate(s) with the hollow part of the breather pipe 250.

In use of the electronic cigarette atomizer, electric current is transformed into heat by the heating wire component 240, and the tobacco juice stored in the oil-absorbing cotton 260 is atomized by heat generated by the heating wire component 240 in the breather pipe 250. The atomized tobacco juice flows along the breather pipe 250 and outflows from the through-hole(s) of the suction nozzle cover 270.

Figure 3:
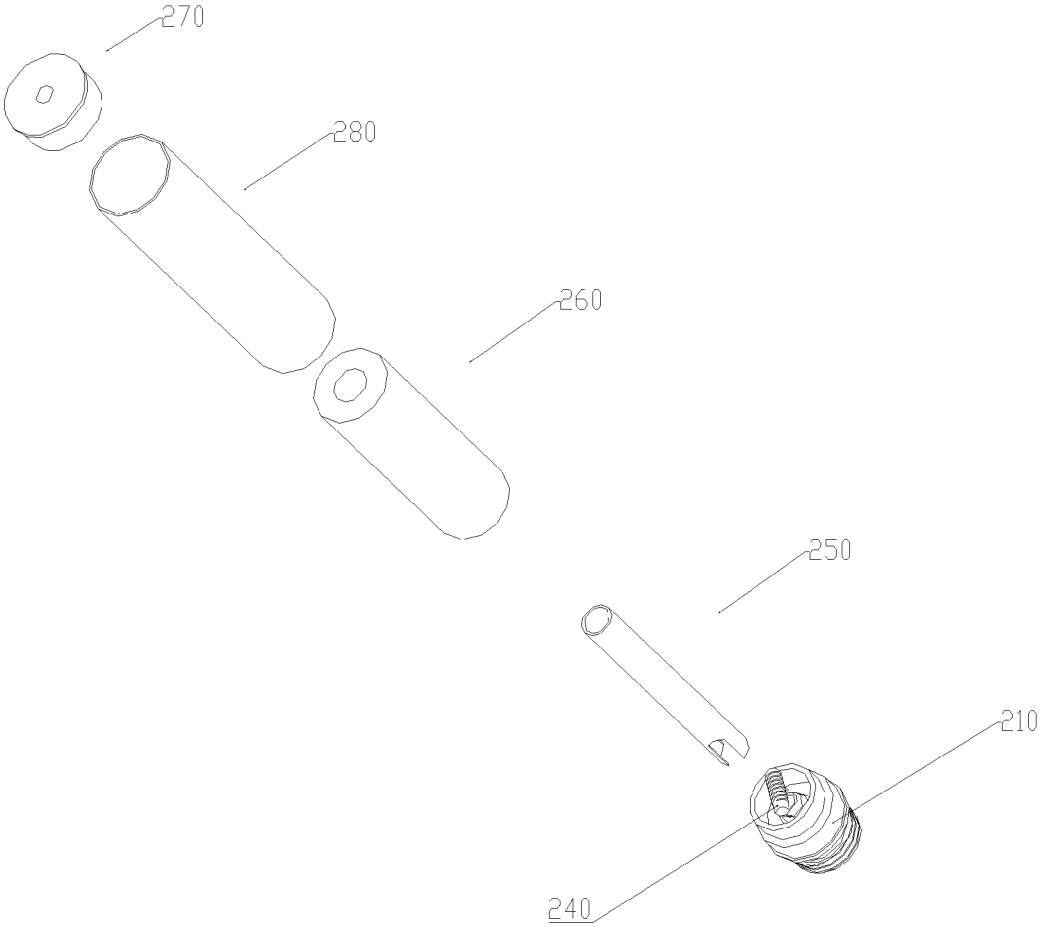
FIG. 3 is a disassembled schematic view of the electronic cigarette atomizer shown in FIG. 2.

In manufacturing and assembly of an electronic cigarette atomizer, the male screw bushing 210, the top electrode 220, the dead ring 230 and the heating wire component 240 are manufactured and assembled as an electrode part. The main heating body of the heating wire component 240 is configured to pass a central axis of the top electrode 220, and an extending orientation of the main heating body is perpendicular to the central axis of the top electrode 220. As shown in FIG. 3, in assembly of the electronic cigarette atomizer, the heating wire component 240 of the electrode part is aligned with and inserted into the U-shaped opening (s) of the breather pipe 250 is/are aligned with the heating wire component 240, and an end of the heating wire component that is adjacent to the U-shaped opening(s) is further inserted into the top electrode 220, and thus the breather pipe 250 is positioned fixedly relative to the electrode component. After that, the breather pipe 250 is aligned with and inserted into the through-hole of the center of the oil-absorbing cotton 260, and the outer sleeve 280 sleeves outside the oil-absorbing cotton 260, such that the male screw bushing 210 is in tight contact with the opening of one end of the outer sleeve 280. Finally, the suction nozzle cover 270 engages with the opening of the other end of the outer sleeve 280, and the whole assembly process of the electronic cigarette atomizer is finished. Compared with original assembly methods, contacting and assembly between the interface of the heating wire component 240 and the electrode is omitted, and the production efficiency is improved. It should be understand that the assembly sequence is not limited and can be diversified. For example, the assembly sequences of the oil-absorbing cotton 260 and the assembly sequence of the outer sleeve 280 can replace each other, that is, the male screw bushing 210 can be firstly screwed into an opening of one end of the outer sleeve 280 tightly; the oil-absorbing cotton 260 can be second inserted into the reception space formed between the outer sleeve 280 and the breather pipe 250; and the suction nozzle cover 270 can be finally mounted onto the other end of the outer sleeve 280.

Figure 4:
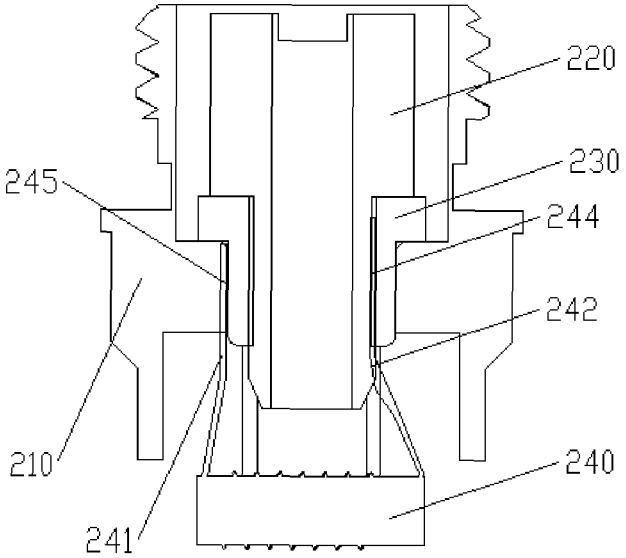
FIG. 4 is an partially enlarged schematic view of the electronic cigarette atomizer shown in FIG. 2.

How the male screw bushing 210, the top electrode 220, the dead ring 230 and the heating wire component 240 are manufactured and assembled as one electrode part is illustrated in detail in FIG. 4 in the following. The male screw bushing 210 is a conductive component, the exterior of the male screw bushing 210 forms thread shapes thereon, and the interior of the male screw bushing 210 is a hollow structure. The interior of the male screw bushing 210 receives a dead ring 230 with an center hole, the outer wall of the dead ring 230 is in tight contact with the inner wall of the male screw bushing 210 each other, and a top electrode 220 is inserted into the center hole of the dead ring 230. One end of the top electrode 220 positioned adjacent to the male screw does not exceed the end of the male screw bushing 210, and the other end of the top electrode 220 protrudes slightly relative to the dead ring 230 to communicate with the breather pipe 250 easily. In order to achieve a more compact assembly and prevent the internal components of the electronic cigarette atomizer from moving relative to each other, the dead ring 230 is made of rubber with elastic characteristic or silica gel, and the dead ring 230 will be compressed slightly when it is completely assembled. The dead ring 230 presses the top electrode 220 and the male screw bushing 210 simultaneously due to recovery of elasticity ability thereof, which makes the dead ring 230, the top electrode 220 and the male screw bushing 210 be positioned fixedly relative to each other. That is, an outer diameter of the dead ring 230 is designed to be a little longer than an inner diameter of the male screw bushing 210, and an inner diameter of the dead ring 230 is designed to be a little shorter than an outer diameter of the top electrode 220. The heating wire component 240 comprises two lead pins: a first lead pin 241 and a second lead pin 242. The first lead pin 241 inserts between the male screw bushing 210 and the dead ring 230, and the second lead pin 242 inserts between the top electrode 220 and the dead ring 230. Due to the elastic recovery ability of the dead ring 230, the first lead pin 241 and the second lead pin 242 are in tight contact with the male screw bushing 210 and the top electrode 220 respectively to ensure an optimized electrical connection effect. The male screw bushing 210, the top electrode 220, the dead ring 230 and the heating wire component 240 are integrated into an electrode part with the function of pinch effect of the dead ring 230, which prevents the heating wire component 240 from generating point-to-point contacts with the male screw bushing 210 and the top electrode 220 in assembly, so that it is more convenient for the assembly of an electronic cigarette atomizer in the present invention.

Figure 5:
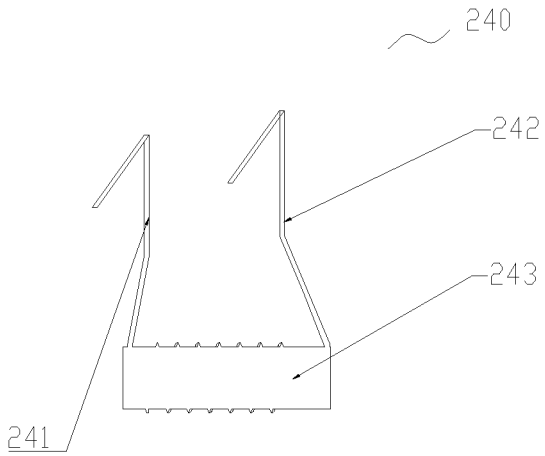
FIG. 5 is a structural view of a heating wire component in accordance with a preferred embodiment of the present invention.

It is preferred that some modifications can also be made for the heating wire component 240 shown in FIG. 4, which are embodied as follows: the heating body 243 is twined with a heating wire (not labeled), and two ends of the helispherical heating wire extend to connect to two lead pins respectively (i.e., the first lead pin 241 and the second lead pin 242), the heating wire, the first lead pin 241 and the second lead pin 242 are formed integrally. Because structures of the first lead pin 241 and the second lead pin 242 are shaped as straight needles, the dead ring 230 may often be impaled by the first lead pin 241 and the second lead pin 242 during the insertion actions of the first lead pin 241 and the second lead pin 242. The heating wire component 240 is further modified to form a shape shown in FIG. 5 in the present invention. The first lead pin 241 and the second lead pin 242 are modified to be bent and form bent parts. In this way, the possibility of an impaled dead ring 230 caused by insecting the first lead pin 241 and the second lead pin 242 into the corresponding gaps can be reduced, and the circumstance of an impaled dead ring 230 is unlikely to happen. Moreover, it is easy to insert every needle-shaped lead pin into the corresponding gap.

The embodiments of the present invention are described in accordance with accompanying figure, however, the present invention shall not be limited to the above-mentioned embodiments which are only considered as some demonstrations instead of limitation to the present invention. Lots of modalities can be made by the one skilled in the art with the help of the inspiration from the present invention without breaking away from the principle and scope of protection of the claims, wherein these modalities are within the scope protected by the present invention.

The invention claimed is:

1. An electronic cigarette atomizer, wherein, the electronic cigarette atomizer comprises a heating wire component (240), a breather pipe (250) and a suction nozzle cover (270), the heating wire component (240) includes a heating body (243), one end of the breather pipe (250) away from the suction nozzle cover (270) defines two U-shaped openings therein, and the heating body (243) of the heating wire component (240) is embedded in the U-shaped openings;

in use of the electronic cigarette atomizer, electric current is transformed into heat by the heating wire component (240), and tobacco juice is atomized by heat generated by the heating wire component (240) in the breather pipe (250), the atomized tobacco juice flows along the breather pipe (250) and outflows from the suction nozzle cover (270);

wherein the electronic cigarette atomizer further comprises a male screw bushing (210) and a top electrode (220) inserted into a dead ring(230), the dead ring (230) is in tight contact with an inner wall of the male screw bushing (210), the top electrode (220) is electrically isolated from the male screw bushing (210), the heating body (243) is entwined by a heating wire, two ends of the heating wire extend to be connect to a first lead pin (241) and a second lead pin (242) respectively, the first lead pin (241) inserts in a first gap (244) between the dead ring (230) and the top electrode (220), and the second lead pin (242) inserts in a second gap (245) between the dead ring (230) and the male screw bushing (210);

wherein the dead ring (230) is made of rubber or silica gel; and wherein the first lead pin (241) and the second lead pin (242) include bent parts, the first lead pin (241) and the second lead pin (242) are inserted into corresponding gaps.

2. The electronic cigarette atomizer according to claim 1, wherein, the heating body (243) passes a central axis of the top electrode (220) and is perpendicular to the central axis of the top electrode (220).

3. The electronic cigarette atomizer according to claim 1, wherein, an outer diameter of the dead ring (230) is longer than an inner diameter of the male screw bushing (210), and an inner diameter of the dead ring (230) is shorter than an outer diameter of the top electrode (220).

4. The electronic cigarette atomizer according to claim 1, wherein, the electronic cigarette atomizer further comprises an outer sleeve (280), the male screw bushing (210) is in a threaded connection with one end of the outer sleeve (280), and the suction nozzle cover (270) inserts into the other end of the outer sleeve (280); the suction nozzle cover (270) defines through-hole(s) therein, and the through-hole(s) communicate(s) with the breather pipe (250).

5. The electronic cigarette atomizer according to claim 4, wherein, a reception space is formed between the outer sleeve (280) and the breather pipe (250), and the reception space receives oil-absorbing cotton (260) therein.

6. The electronic cigarette atomizer according to claim 1, wherein, the heating wire component (240), the first lead pin (241) and the second lead pin (242) are formed integrally.

* * * * *